US010420376B2

(12) United States Patent
Qiu

(10) Patent No.: US 10,420,376 B2
(45) Date of Patent: Sep. 24, 2019

(54) ELECTRONIC CIGARETTE

(71) Applicant: Joyetech (Changzhou) Electronics Co., Ltd., Changzhou, Jiangsu Province (CN)

(72) Inventor: Weihua Qiu, Changzhou (CN)

(73) Assignee: JOYETECH (CHANGZHOU) ELECTRONICS CO., LTD., Changzhou, Jiangsu Province (CN)

( * ) Notice: Subject to any disclaimer, the term of this patent is extended or adjusted under 35 U.S.C. 154(b) by 0 days.

(21) Appl. No.: 15/724,268

(22) Filed: Oct. 3, 2017

(65) Prior Publication Data

US 2018/0020738 A1 Jan. 25, 2018

Related U.S. Application Data

(63) Continuation-in-part of application No. PCT/CN2016/090673, filed on Jul. 20, 2016.

(30) Foreign Application Priority Data

Jun. 8, 2016 (CN) ..... 2016 1 0406045

(51) Int. Cl.
*A24F 47/00* (2006.01)
*F22B 1/28* (2006.01)

(52) U.S. Cl.
CPC ..... *A24F 47/008* (2013.01); *F22B 1/284* (2013.01)

(58) Field of Classification Search
None
See application file for complete search history.

(56) References Cited

U.S. PATENT DOCUMENTS

2011/0226236 A1* 9/2011 Buchberger ..... A61M 11/041 128/200.23

FOREIGN PATENT DOCUMENTS

| | | | |
|---|---|---|---|
| CN | 203692552 | U | 7/2014 |
| WO | 2015/120588 | A1 | 8/2015 |
| WO | 2015/120591 | A1 | 8/2015 |
| WO | 2015/120636 | A1 | 8/2015 |
| WO | PCT/CN2016/090673 | | 7/2016 |

* cited by examiner

*Primary Examiner* — Michael J Felton
(74) *Attorney, Agent, or Firm* — Cheng-Ju Chiang

(57) ABSTRACT

The present invention provides an electronic cigarette. The electronic cigarette includes a sensor, an atomizing assembly and a liquid storage unit, which are disposed in a housing. The atomizing assembly is provided with a first airflow passage. A second airflow passage is provided in the housing, and the sensor is disposed in the second airflow passage. The housing is defined with a first air inlet and a second air inlet. The first air inlet is in fluid communication with the first airflow passage. The second air inlet is in fluid communication with the second airflow passage. The first airflow passage and the second airflow passage are isolated from each other by a partition member.

10 Claims, 14 Drawing Sheets

ELECTRONIC CIGARETTE

CROSS REFERENCE TO RELATED APPLICATIONS

This application is a continuation-in-part of International Patent Application NO. PCT/CN2016/090673, filed on Jul. 20, 2016, which claim priority to Chinese Patent Application NO. CN201610406045.8, filed on Jun. 8, 2016.

TECHNICAL FIELD

The present application relates to simulated smoking technology, and more particularly to an improved electronic cigarette.

BACKGROUND

Electronic cigarettes have become a relatively matured substitute for smoking currently on the market. When a heating element of an atomizer of the electronic cigarette is energized by a battery, cigarette liquid is heated by the heating element to generate smoke, such that the user gets the smoking experience.

However, in prior arts, for an electronic cigarette provided with an airflow sensor, the airflow sensor is generally disposed opposite to the mouthpiece. Thus, the airflow sensor is located far away from the mouthpiece, the response speed of the airflow sensor will be influenced, and the user cannot get a favorable smoking experience. Furthermore, the airflow sensor is generally located in the smoke passage, after the airflow sensor is used many times, part of the smoke in the smoke passage will condense into oil-smoke and accumulate on the airflow sensor, which may influence the sensitivity of the airflow sensor.

SUMMARY

In view of the above, it is necessary to provide an electronic cigarette with an improved smoking experience for the user, to satisfy the demand of the market.

The technical proposal of the present application is set forth below:

An electronic cigarette is provided. The electronic cigarette includes a sensor and an atomizing assembly both of which are disposed in a housing. The atomizing assembly is provided with a first airflow passage. A second airflow passage is provided in the housing, and the sensor is disposed in the second airflow passage. The housing is defined with a first air inlet and a second air inlet. The first air inlet is in fluid communication with the first airflow passage. The second air inlet is in fluid communication with the second airflow passage. The first airflow passage and the second airflow passage are isolated from each other by a partition member.

Further, the atomizing assembly includes an air inlet passage and an air outlet passage, the air inlet passage is in fluid communication with the first air inlet, the air outlet passage is in fluid communication with the first airflow passage.

Further, the housing includes a main body and a suction body connected at one end of the main body, the partition member is formed in the suction body.

Further, the main body further includes a connection part provided at the end of the main body to which the suction body is connected, the connection part is provided with two mounting holes which are separately formed, the atomizing assembly is mounted through one of the mounting holes in the main body, and the sensor is mounted in the other one of the mounting holes.

Further, the atomizing assembly includes an atomizer head and a venting unit, the atomizer head is disposed at one end of the venting unit, the venting unit is provided with a lower air outlet passage in fluid communication with the first airflow passage, and the venting unit is further provided with a venting hole in fluid communication with the first air inlet.

Further, the venting unit includes a venting connection piece, an inner air pipe and an outer air pipe, the inner air pipe and the outer air pipe are connected with the venting connection piece, the inner air pipe is disposed inside the outer air pipe, the gap between the inner air pipe and the outer air pipe forms as an air inlet passage, the air inlet passage is in fluid communication with the venting hole, the lower air outlet passage is formed by an interior passage of the inner air pipe, the venting connection piece is provided with an upper air outlet passage, wherein the air inlet passage, the lower air outlet passage and the upper air outlet passage are in fluid communication with the first airflow passage.

Further, the atomizer head includes an atomizing tube, a heating element, an atomizing base and a first contact member, the heating element, the atomizing base and the first contact member are disposed in the atomizing tube, the heating element is located above the atomizing base, the atomizing tube is provided with an atomizing outlet at one end thereof, the atomizing base is disposed at the other end of the atomizing tube opposite to the atomizing outlet, the first contact member is disposed at a bottom side of the atomizing base.

Further, a top end of the atomizer head is threadedly connected with a bottom end of the outer air pipe, the atomizing outlet is in fluid communication with the air inlet passage and the lower air outlet passage.

Further, the atomizer head further includes a liquid absorbing member, the liquid absorbing member wraps up the heating element or the liquid absorbing member is wrapped up by the heating element.

Further, the venting hole is defined in a sidewall of the venting connection piece, the inner air pipe and the outer air pipe are disposed under the venting connection piece.

Further, the electronic cigarette further includes a liquid storage unit in fluid communication with the atomizing assembly, the liquid storage unit is disposed in the main body, the liquid storage unit includes a liquid storage sleeve and an end sealing element, the gap between the inner wall of the liquid storage sleeve and the outer wall of the outer air pipe forms as a liquid storage chamber, the end sealing element is provided at one end of the liquid storage sleeve, and the other end of the liquid storage sleeve is mounted around a bottom side of the mounting hole in which the atomizing assembly is mounted.

Further, the liquid storage unit further includes a second contact member mounted on the end sealing element, the second contact member is electrically connected with the first contact member.

Further, the partition member is integrally formed with the suction body.

Further, the second air inlet is defined in a sidewall and/or a bottom wall of the housing.

Further, the electronic cigarette further includes an energy device, the energy device provides power energy for the atomizing assembly.

According to another aspect of this disclosure, a suction body is provided.

The suction body comprises at least one first airflow passage and at least one second airflow passage. All the first airflow passages are isolated from all the second airflow passages. Each first airflow passage is in fluid communication with an air channel in which smoke is generated. Each second airflow passage is in fluid communication with a sensor.

Further, the sensor is located in an air channel which is in fluid communication with one second airflow passage, or is located in one second airflow passage.

Further, the suction body further comprises a matching part located at one end of the suction body and configured to connect the suction body with a main body of an electronic cigarette or a atomizer.

Further, the matching part comprises a first matching part and a second matching part. The first matching part forms as a part of one first airflow passage, and the second matching part forms as a part of one second airflow passage.

According to another aspect of this disclosure, an atomizer is provided

The atomizer comprises a first airflow passage and a second airflow passage. The first airflow passage and the second airflow passage are isolated from each other by a partition member. Smoke generated by atomizing flows out from the atomizer through the first airflow passage. A sensor is optionally mounted in the second airflow passage.

Further, a sensor probe is mounted at an end of the atomizer. The sensor probe is configured to allow a signal connection between the senor and a control board, and allow an electrical connection between the sensor and a battery.

Further, the atomizer further comprises a liquid storage sleeve received in a main body. The first airflow passage is located in the liquid storage sleeve. The space between the liquid storage sleeve and the main body forms as the second airflow passage. The liquid storage sleeve acts as the partition member.

Further, the atomizer further comprises a venting unit received in the liquid storage sleeve. The venting unit comprises an inner air pipe and an outer air pipe disposed outside the inner air pipe. The gap between the inner air pipe and the outer air pipe forms as an air inlet passage, and the interior passage of the inner air pipe forms as an air outlet passage. The air inlet passage and the air outlet passage together constitute the first airflow passage.

Compared with the prior arts, the electronic cigarette of the present application includes a sensor and an atomizing assembly both of which are disposed in a housing. The atomizing assembly is provided with a first airflow passage. A second airflow passage is provided in the housing, and the sensor is disposed in the second airflow passage. The housing is defined with a first air inlet and a second air inlet. The first air inlet is in fluid communication with the first airflow passage. The second air inlet is in fluid communication with the second airflow passage. The first airflow passage and the second airflow passage are isolated from each other by a partition member. Since the first airflow passage is isolated from the second airflow passage by the partition member, so that the sensor is unaffected when a user inhales smoke from the smoke passage, the sensitivity of the sensor is not reduced, and the smoking experience for the user is improved.

The preferred embodiments of the present application and its advantages are further explained in detail with reference to specific embodiments.

BRIEF DESCRIPTION OF THE DRAWINGS

The accompanying drawings are intended to provide a further understanding of the present application and constitute a part of the specification, in conjunction with the following specific embodiments for interpretation of the present application, but shall not constitute a limitation to the present application.

Figure 1:
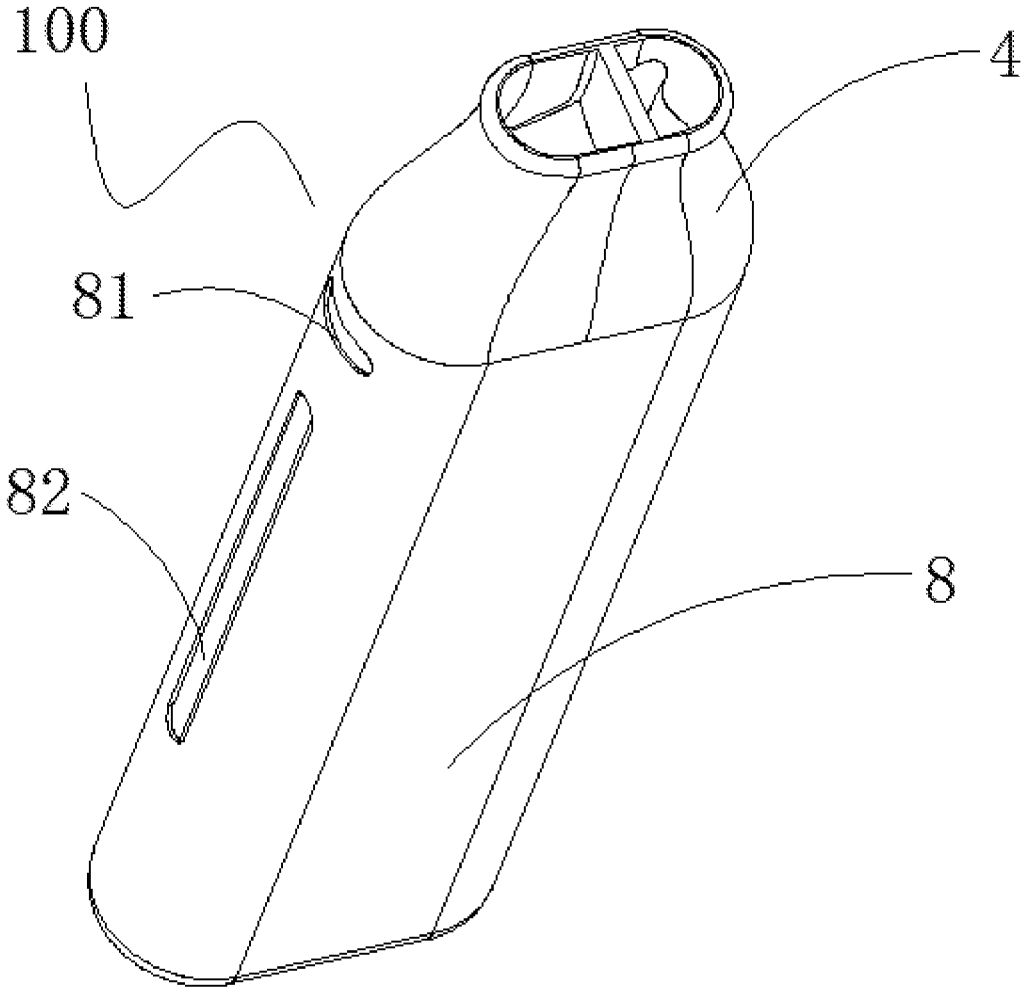
FIG. 1 is an isometric view illustrating an electronic cigarette according to a first embodiment of the present application.

In the drawings, the reference numbers are listed below: battery 1; atomizer head 11; first airflow passage 50, 411; lower air outlet passage 61; control board 2; liquid inlet hole 111; venting hole 51; first air inlet 81; sensor 3; heating element 12; air inlet passage 52; window 82; suction body 4; atomizing base 13; upper air outlet passage 53; end sealing element 21; venting connection piece 5; first contact member 14; upper outer thread 54; partition member 41, 413; inner air pipe 6; second contact member 15; lower outer thread 71; bottom end 181; outer air pipe 7; connecting line 16; atomizing tube 19; liquid storage chamber 91; main body 8; second air inlet 17; venting unit 20; first end 121; liquid storage sleeve 9; connection part 18; lower inner thread 191; second end 122; bottom seat 10; second airflow passage 40, 412; atomizing outlet 192; electronic cigarette 100; first matching part 421; second matching part 422; smoke outlet 4111; through hole 4121; atomizer 30; auxiliary suction nozzle 301; sensor probe 302; switch 31.

DETAILED DESCRIPTION OF PREFERRED EMBODIMENTS

The specific embodiments of the present application are described below in detail with reference to the drawings. It should be understood that the specific embodiments described herein are intended only for illustration of the present application, and are not intended to limit the present application.

Figure 2:
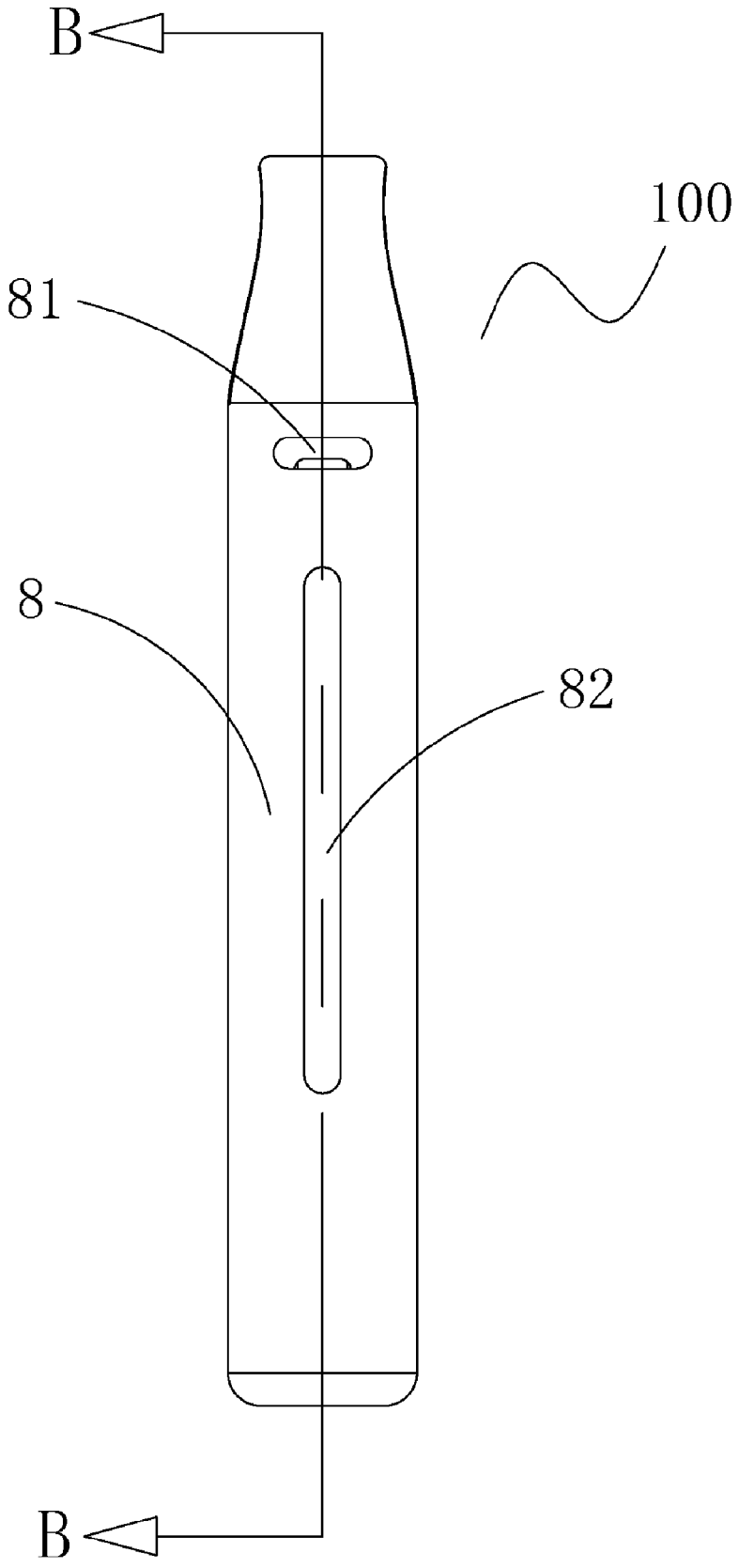
FIG. 2 is a side view of the electronic cigarette of FIG. 1.
Figure 3:
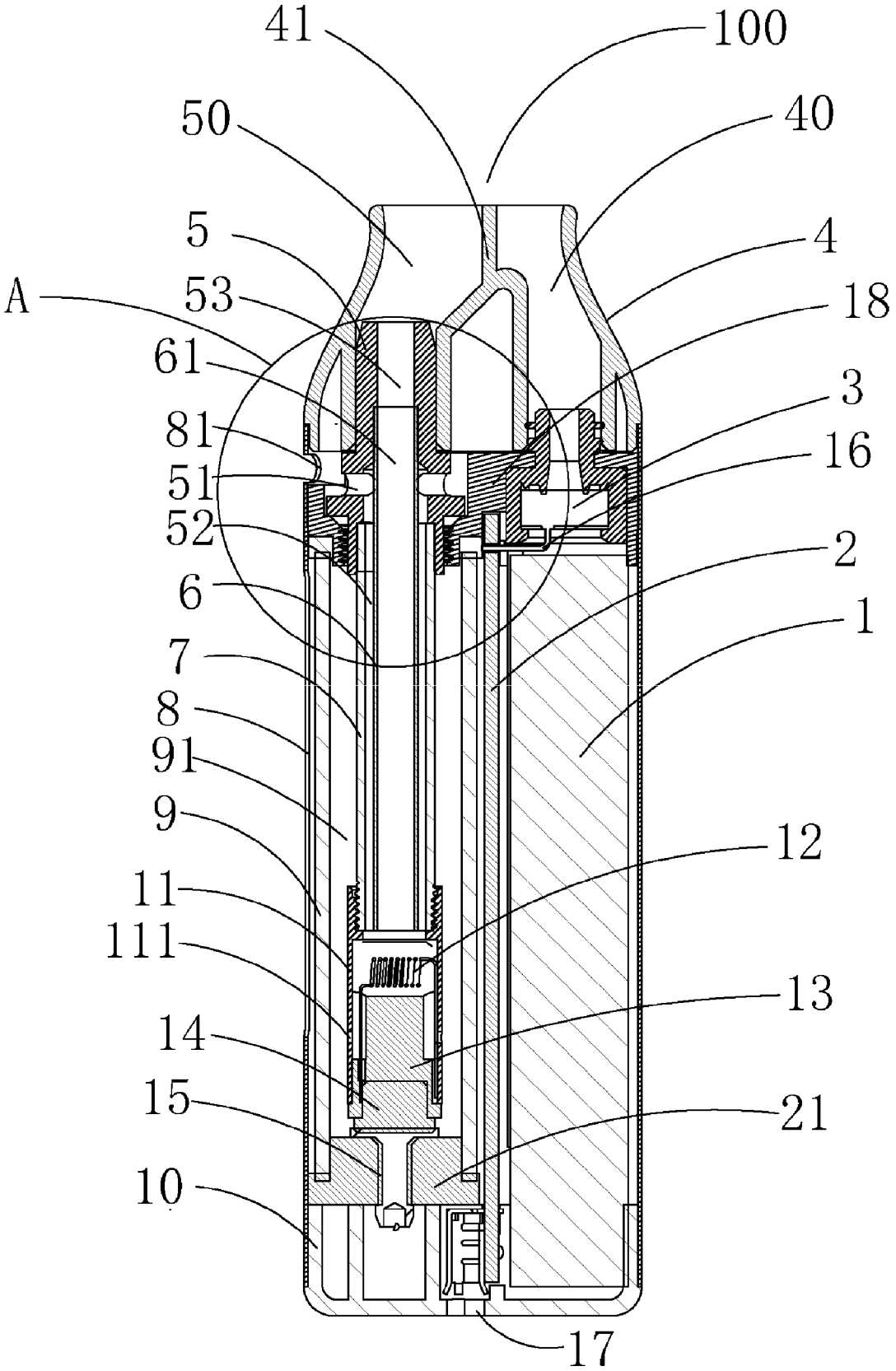
FIG. 3 is a cross sectional view of the electronic cigarette of FIG. 2 along the line of B-B.

Referring to FIGS. 1-3, an electronic cigarette 100 is provided according to the first embodiment of the present application. The electronic cigarette 100 includes an energy device, a sensor 3, an atomizing assembly, and a liquid storage unit. The energy device, the sensor 3, the atomizing assembly and the liquid storage unit are disposed in a housing. The sensor 3 is signal connected with the energy device. Specifically, referring to FIG. 3, the energy device includes a battery 1 and a control board 2. The sensor 3 may signal connect with the control board 2 by a connecting line 16, and the control board 2 is electrically connected to the battery 1. When the sensor 3 sends out control signals to the control board 2, the control board 2 controls the battery 1 to energize the atomizing assembly, and the electronic cigarette 100 performs the atomizing function.

According to an example of the embodiment, the energy device can also be an apparatus that adopts chemical reaction or infrared radiation to generate heat.

Referring to FIGS. 3-6, according to the electronic cigarette 100 illustrated in the embodiment of the present application, the atomizing assembly is provided with a first airflow passage 50, a second airflow passage 40 is provided in the housing, and the sensor 3 is disposed in the second airflow passage 40. The housing is defined with a first air inlet 81 and a second air inlet 17. The first air inlet 81 is in fluid communication with the first airflow passage 50. The second air inlet 17 is in fluid communication with the second airflow passage 40. The first airflow passage 50 and the second airflow passage 40 are isolated from each other by a partition member 41.

It can be seen from the above, in the electronic cigarette 100 provided by the embodiment, the first airflow passage 50 is isolated from the second airflow passage 40 by the partition member 41. Thus, in the use of the electronic cigarette 100, the smoke generated by the atomizing assembly flows in the first airflow passage 50. However, the second airflow passage 40, in which the sensor 3 is disposed, is isolated from the first airflow passage 50 by the partition member 41, such that the airflows in the two airflow passages are not mixed before being inhaled by the user. That is, the smoke will not flow through the second airflow passage 40. Therefore, even if the smoke condenses, its influence on the sensitivity of the sensor 3 is greatly reduced. Accordingly, the sensor 3 can sensitively control the battery 1 to energize or not. As a result, the smoking experience for the user is improved.

Figure 4:
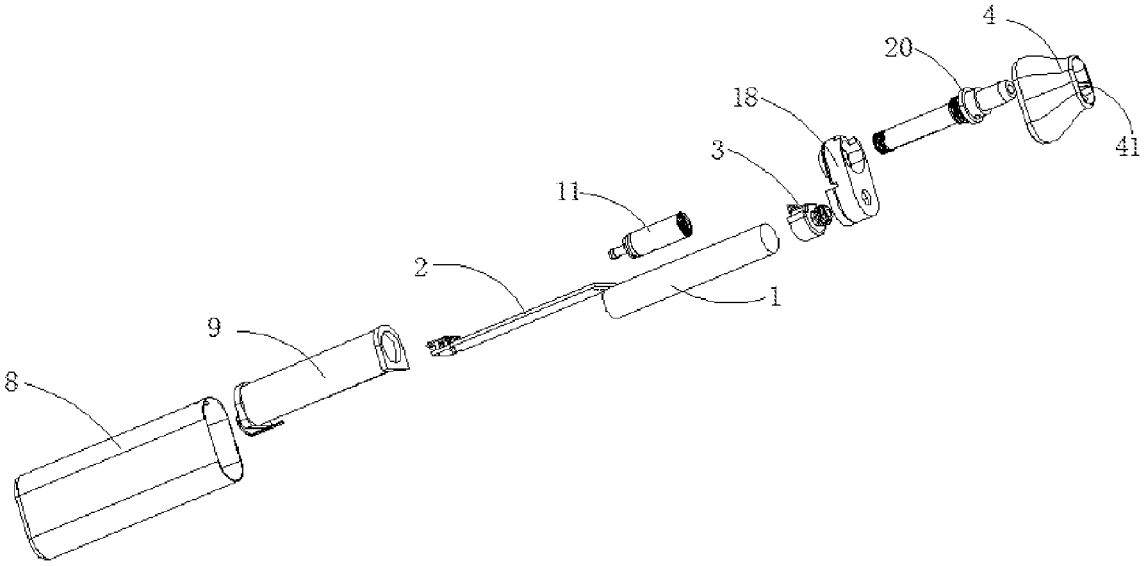
FIG. 4 is an exploded view of the electronic cigarette of FIG. 1.
Figure 5:
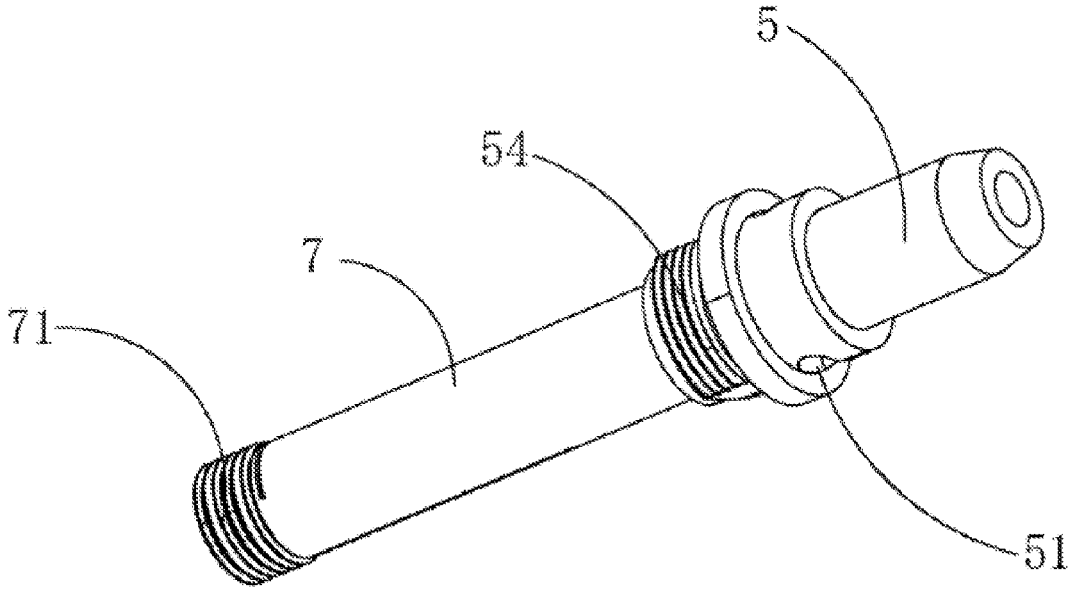
FIG. 5 is an isometric view of a venting unit illustrated in the first embodiment.

According to an example of the embodiment, referring to FIGS. 3-5, the aforementioned housing includes a main body 8 and a suction body 4 connected at one end of the main body 8. The partition member 41 is formed in the suction body 4. Through forming the housing by separate parts, the producing and assembling of the housing becomes relatively simple, and the quality of the product is improved. The atomizing assembly, the sensor and other parts are assembled in the main body 8, and finally the suction body 4 is mounted, it is therefore convenient to check the states of all of the parts. Further, when the suction body 4 needs to be replaced, it is also convenient. In one embodiment, the partition member 41 is integrally formed with the suction body 4, to thereby reduce the manufacturing steps.

According to an example of the embodiment, the main body 8 further includes a connection part 18 provided at the end of the main body 8 to which the suction body 4 is connected. In the connection part 18, there are provided with two mounting holes which are separately formed, wherein the atomizing assembly is mounted in the main body 8 through one of the mounting holes, and the sensor 3 is mounted in the other one of the mounting holes. Thus, through forming two mounting holes in the connection part 18, the atomizing assembly and the sensor 3 are further isolated, to ensure the first airflow passage 50 and the second airflow passage 40 are not overlapped.

Figure 6:
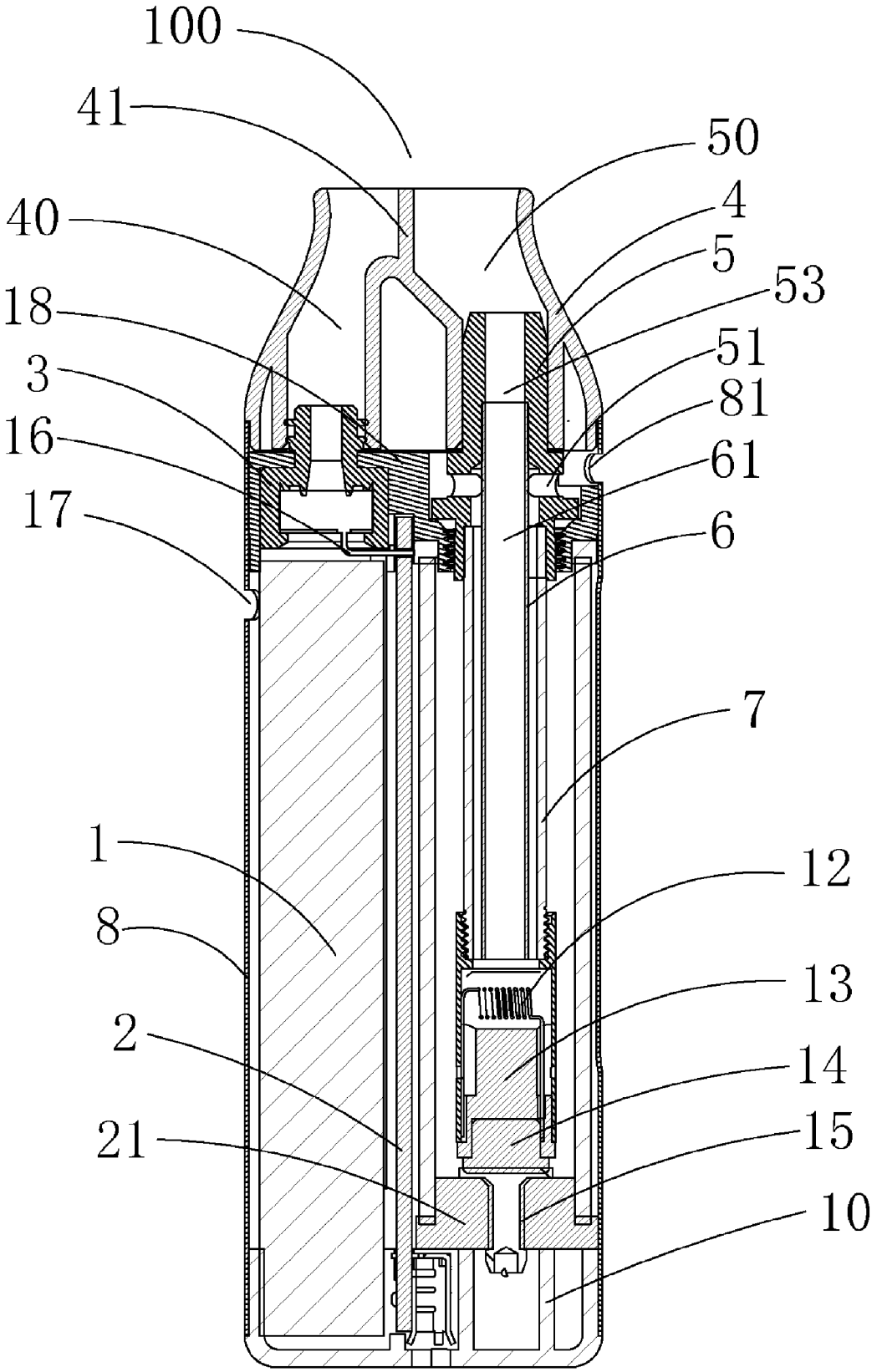
FIG. 6 is a cross sectional view of the electronic cigarette of FIG. 2 along the opposite direction of the line of B-B.

Referring to FIG. 3 and FIG. 6, according to an example of the embodiment, the main body 8 further includes a bottom seat 10. The bottom seat 10 is provided at the bottom end of the main body 8. The second air inlet 17 can be defined in the bottom seat 10. Alternatively, as shown in FIG. 6, the second air inlet 17 can also be defined in a sidewall of the main body 8. When the second air inlet 17 is defined in the sidewall of the main body 8, the second air inlet 17 is located closer to the suction body 4 of the electronic cigarette 100. Thus, the resistance is relatively low, and the sensor 3 can have a higher sensitivity.

According to an example of the embodiment, referring to FIG. 3, the atomizing assembly includes an atomizer head 11 and a venting unit 20. The atomizer head 11 is disposed at one end of the venting unit 20. The venting unit 20 is provided with a lower air outlet passage 61 in fluid communication with the first airflow passage 50. The venting unit 20 is further provided with a venting hole 51 in fluid communication with the first air inlet 81. According to an example, the venting unit 20 includes a venting connection piece 5, an inner air pipe 6, and an outer air pipe 7, wherein the inner air pipe 6 and the outer air pipe 7 are connected with the venting connection piece 5. The inner air pipe 6 is disposed inside the outer air pipe 7. The gap between the inner air pipe 6 and the outer air pipe 7 forms as an air inlet passage 52. The air inlet passage 52 is in fluid communication with the venting hole 51. The lower air outlet passage 61 is formed by an interior passage of the inner air pipe 6. In the venting connection piece 5, there is provided with an upper air outlet passage 53. The air inlet passage 52, the lower air outlet passage 61 and the upper air outlet passage 53 are in fluid communication with the first airflow passage 50.

Referring to FIGS. 3-9, according to an example of the embodiment, when the user performs inhaling operation on the suction body 4 of the electronic cigarette 100, due to the existence of the partition member 41, the external air is inhaled by the user from two separate paths. In one of the paths, a portion of the external air enters from the first air inlet 81, and then flows through the venting hole 51, the air inlet passage 52, the lower air outlet passage 61 and the upper air outlet passage 53 to reach the first airflow passage 50. In the other one of the paths, a portion of the external air enters into the housing from the second air inlet 17, and then flows through the sensor 3 to reach the second airflow passage 40. As the portion of the external air flows through the sensor 3, the sensor 3 is triggered to generate a signal to the control board 2 of the energy device, to control the battery 1 to output energy power. It is noted that, the external air flows along the two paths concurrently and separately, wherein the external air flowing through the sensor 3 can trigger the sensor 3 to generate a signal to the control board 2 of the energy device, so that the battery 1 is controlled to output energy power. After the atomizing assembly gets the energy power from the battery 1, the atomizer head 11 of the atomizing assembly uses the heating element 12 to heat and atomize the cigarette liquid to generate smoke. The generated smoke discharges out from an atomizing outlet 192, and the external air after entering from the first air inlet 81 and flowing through the air inlet passage 52 can take away the generated smoke. The external air and the smoke are mixed together and flow through the lower air outlet passage 61 and the upper air outlet passage 53 to reach the first airflow passage 50, for finally being inhaled by the user.

Referring to FIGS. 5-9, according to an example of the embodiment, the atomizer head 11 includes an atomizing tube 19, a heating element 12, an atomizing base 13, and a first contact member 14. The heating element 12, the atomizing base 13 and the first contact member 14 are disposed in the atomizing tube 19. The heating element 12 is located above the atomizing base 13. The atomizing tube 19 is provided with an atomizing outlet 192 at one end thereof. The atomizing base 13 is disposed at the other end of the atomizing tube 19 opposite to the atomizing outlet 192. The first contact member 14 is disposed at a bottom end of the atomizing base 13.

Figure 8:
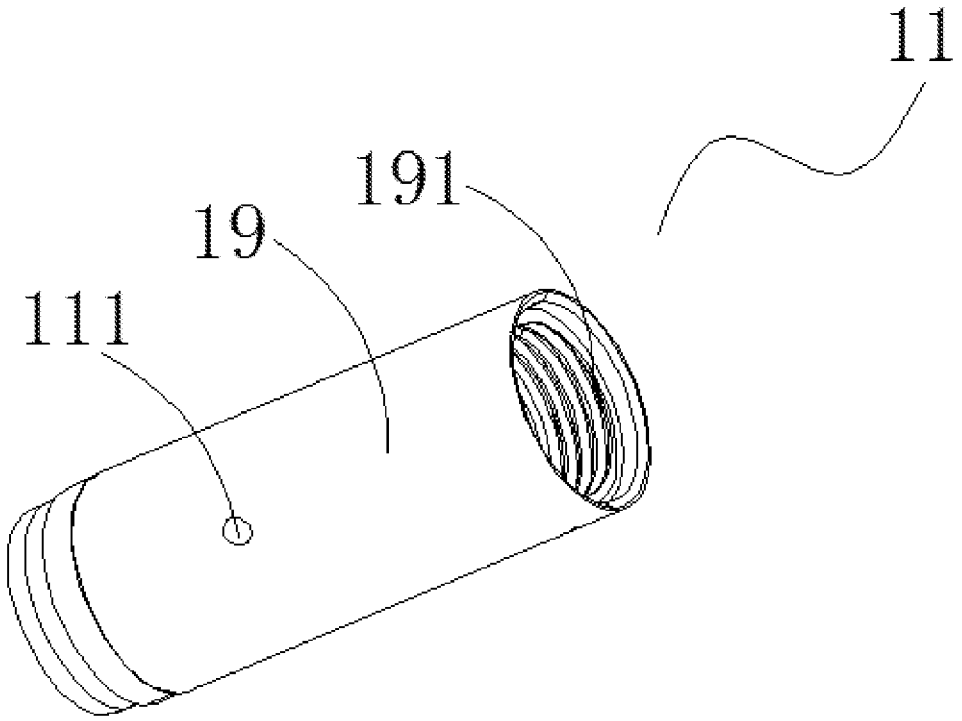
FIG. 8 is an isometric view of an atomizer head of FIG. 4.

According to an example of the embodiment, a top end of the atomizer head 11 is threadedly connected with a bottom end of the outer air pipe 7. Particularly, referring to FIG. 5 and. FIG. 8, the top end of the atomizer head 11 is provided with a lower inner thread. 191, and the bottom end of the outer air pipe 7 of the venting unit 20 is provided with a lower outer thread 71 engageable with the lower inner thread 191, such that the atomizer head 11 can be fixed to the bottom end of the venting unit 20. The atomizing outlet 192 is in fluid communication with the air inlet passage 52 and the lower air outlet passage 61. In the use of the electronic cigarette, a portion of the external air enters into the atomizing assembly from the first air inlet 81, the venting hole 51 and the air inlet passage 52. The atomizer head 11 heats and atomizes the cigarette liquid to generate smoke, the generated smoke is taken away by this portion of the external air and then flows through the lower air outlet passage 61 and the upper air outlet passage 53 to enter into the first airflow passage 50, finally for the user to inhale. The atomizer head 11 further includes a liquid absorbing member, wherein the liquid absorbing member wraps up the heating element 12, or the liquid absorbing member is wrapped up by the heating element 12. The material for the liquid absorbing member can be porous ceramics, cotton, cotton cloth, porous metals, etc., so long as the liquid absorbing member can absorb the cigarette liquid and store a certain amount of the cigarette liquid.

Figure 7:
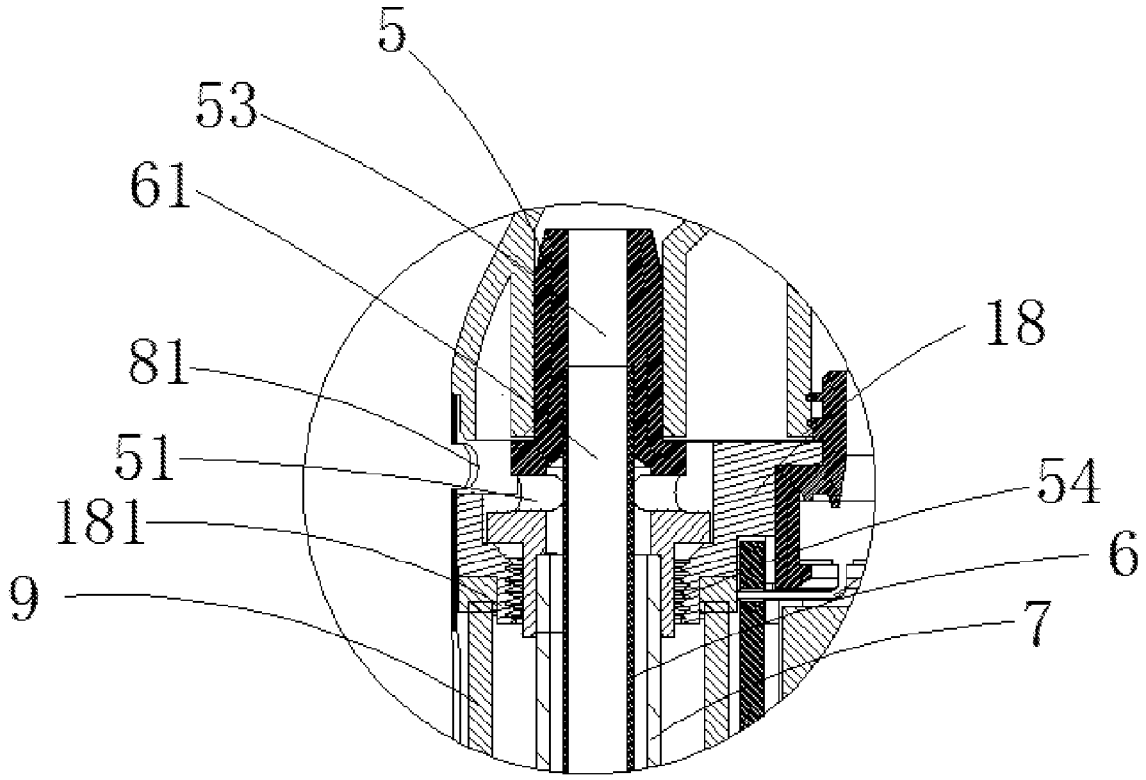
FIG. 7 is a partially enlarged view of the portion A of FIG. 3.

Referring to FIG. 3 and FIG. 7, the venting hole 51 is defined in a sidewall of the venting connection piece 5. The inner air pipe 6 and the outer air pipe 7 are disposed under the venting connection piece 5. The liquid storage unit is disposed in the main body 8. The liquid storage unit includes a liquid storage sleeve 9 and an end sealing element 21. The gap between the inner wall of the liquid storage sleeve 9 and the outer wall of the outer air pipe 7 forms as a liquid storage chamber 91. The end sealing element 21 is provided at one end of the liquid storage sleeve 9, and the other end of the liquid storage sleeve 9 is mounted around a bottom side of the mounting hole in which the atomizing assembly is mounted.

Referring to FIG. 5 and FIG. 7, the bottom end of the venting connection piece 5 is provided with an upper outer thread 54.The mounting hole, in which the atomizing assembly is mounted, is provided with an upper inner thread engaged with the upper outer thread 54, as shown in FIG. 7. In addition, according to an example of the embodiment, the top end of the liquid storage sleeve 9 is connected to a bottom end 181 of the connection part 18 by an interference fit, a silicon gasket can be mounted therebetween for preventing the cigarette liquid from leakage. A sidewall of the atomizing tube 19 is defined with a liquid inlet hole 111, such that the cigarette liquid in the liquid storage chamber 91 can enter from the liquid inlet hole 111 into an interior of the atomizer head 11 to be heated and atomized by the heating element 12.

According to an example of the embodiment, referring to FIGS. 1-3, the sidewall of the main body 8 is provided with a window 82. The liquid storage sleeve 9 may be made of a transparent or translucent material. From the window 82, the cigarette liquid in the liquid storage chamber 91 can be observed through the liquid storage sleeve 9 made of a transparent or translucent material, to prevent a dry burning problem occurred when the liquid storage chamber 91 of the electronic cigarette has no cigarette liquid or is lack of cigarette liquid.

Figure 9:
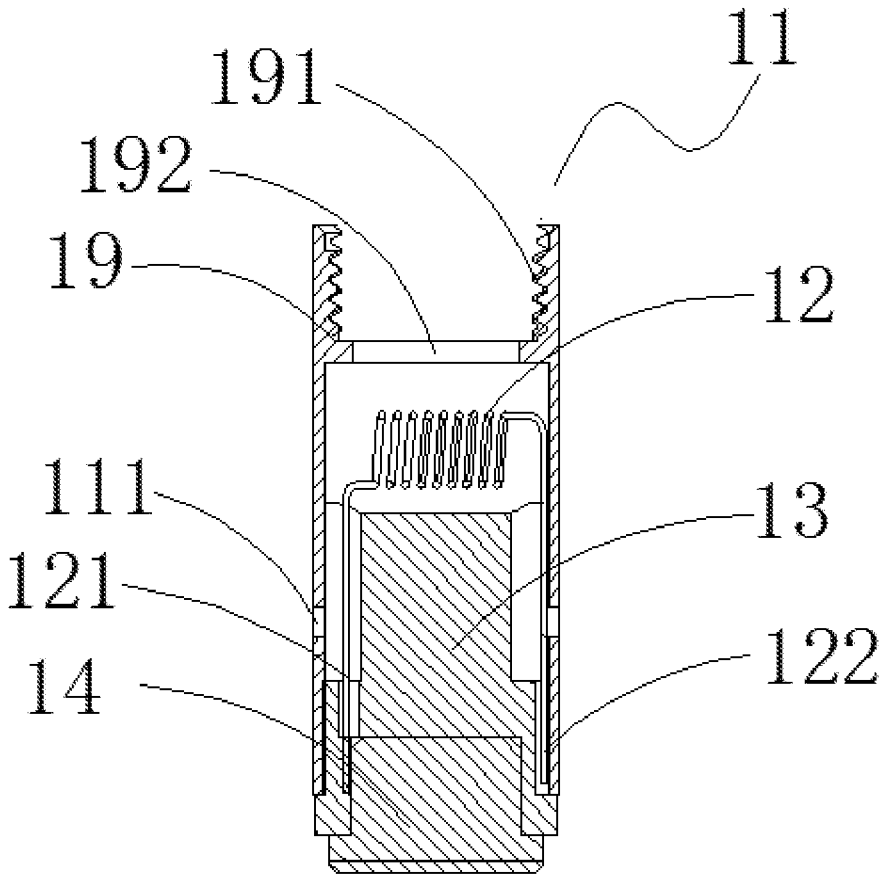
FIG. 9 is a cross sectional view of the atomizer head of FIG. 8.

Referring to FIG. 3 and FIG. 9, the liquid storage unit further includes a second contact member 15 mounted on the end sealing element 21. The second contact member 15 is electrically connected to the first contact member 14. The first contact member 14 can be electrically connected to an electrode of the battery 1. Thus, a first end 121 of the heating element 12 in the atomizer head 11 can be electrically connected to an electrode of the battery 1 by the first contact member 14 and the second contact member 15, and a second end 122 of the heating element 12 can be electrically connected to the other electrode of the battery 1 through other ways. For example, the atomizing tube 19, the outer air pipe 7, the venting connection piece 5, the connection part 18 and other related parts can be made of electrically conductive materials, and the second end 122 of the heating element 12 is electrically connected to the other electrode of the battery 1 after electrically connecting with the atomizing tube 19. It is well known by a person skilled in the art, there are other methods to realize the electrical connection, for example, a relatively simple method is to use an electrical wire to connect the second end 122 of the heating element 12 with the other electrode of the battery 1.

Figure 10:
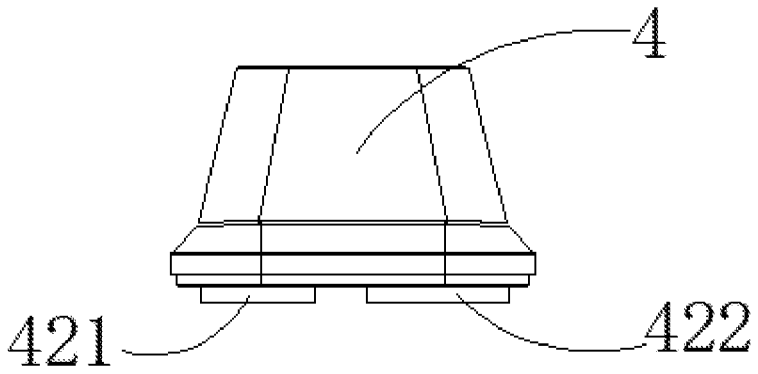
FIG. 10 is a front view of a suction body according to a second embodiment of the present application.
Figure 11:
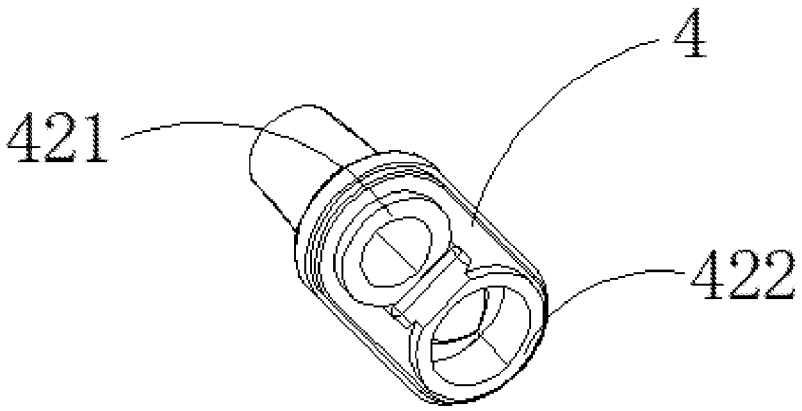
FIG. 11 is an isometric view of the suction body of FIG. 10.
Figure 12:
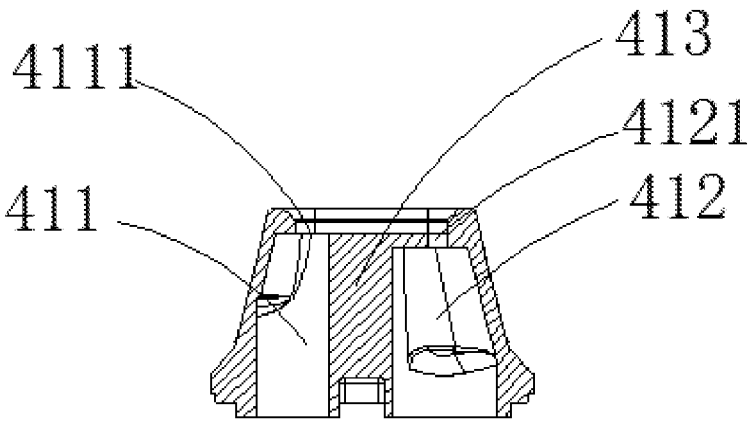
FIG. 12 is a cross sectional view of the suction body of FIG. 10.

Referring to FIGS. 10-12, a suction body 4 is provided according to the second embodiment of the present application. The suction body 4 includes a first airflow passage 411 and a second airflow passage 412. The first airflow passage 411 and the second airflow passage 412 are isolated from each other by a partition member 413. When the suction body 4 is mounted onto an electronic cigarette or an atomizer, the first airflow passage 411 is in fluid communication with an air channel in which the smoke is generated, and the second airflow passage 412 is in fluid communication with a sensor, which means the sensor is located in an air channel which is in fluid communication with the second airflow passage 412, or the sensor is directly located in the second airflow passage 412.

Figure 13:
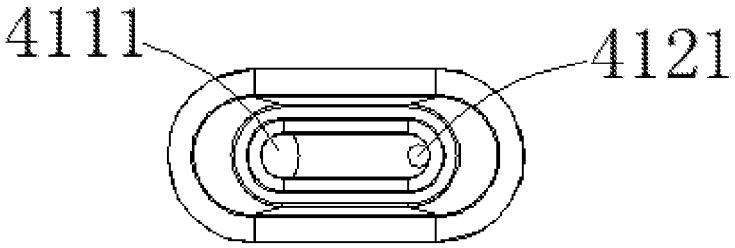
FIG. 13 is a top view of the suction body of FIG. 10.

Referring to FIG. 13, a smoke outlet 4111 is defined at the upper end of the first airflow passage 411, and is configured to allow the smoke to flow out when the suction body 4 is mounted on the electronic cigarette or the atomizer. A through hole 4121 is defined at the upper end of the second airflow passage 412, and is configured to allow the airflow from the air channel in which the sensor is mounted to flow out when the suction body 4 is mounted on the electronic cigarette or the atomizer. When a user inhales, the air channel in which the sensor is mounted generates a negative pressure and triggers the sensor to send control signals to a control board. Alternatively, when the sensor is mounted in the second airflow passage 412, the second airflow passage 412 generates a negative pressure and triggers the sensor to send control signals to a control board under the user's suction.

A first matching part 421 is provided at the lower end of the first airflow passage 411, and a second matching part 422 is provided at the lower end of the second airflow passage 412, for ease of positioning and installation. The first matching part 421 forms as a part of the first airflow passage 411, and the second matching part 422 forms as a part of the second airflow passage 412.

Since the first airflow passage 411 and the second airflow passage 412 are isolated from each other by the partition member 413, the smoke can flow within the first airflow passage 411 without affecting the sensitivity of the sensor located in the air channel in fluid communication with the second airflow passage 412 or the sensor located in the second airflow passage 412. And the suction body 4 as a spare part provides the users an additional option, and the versatility is increased.

Figure 19:
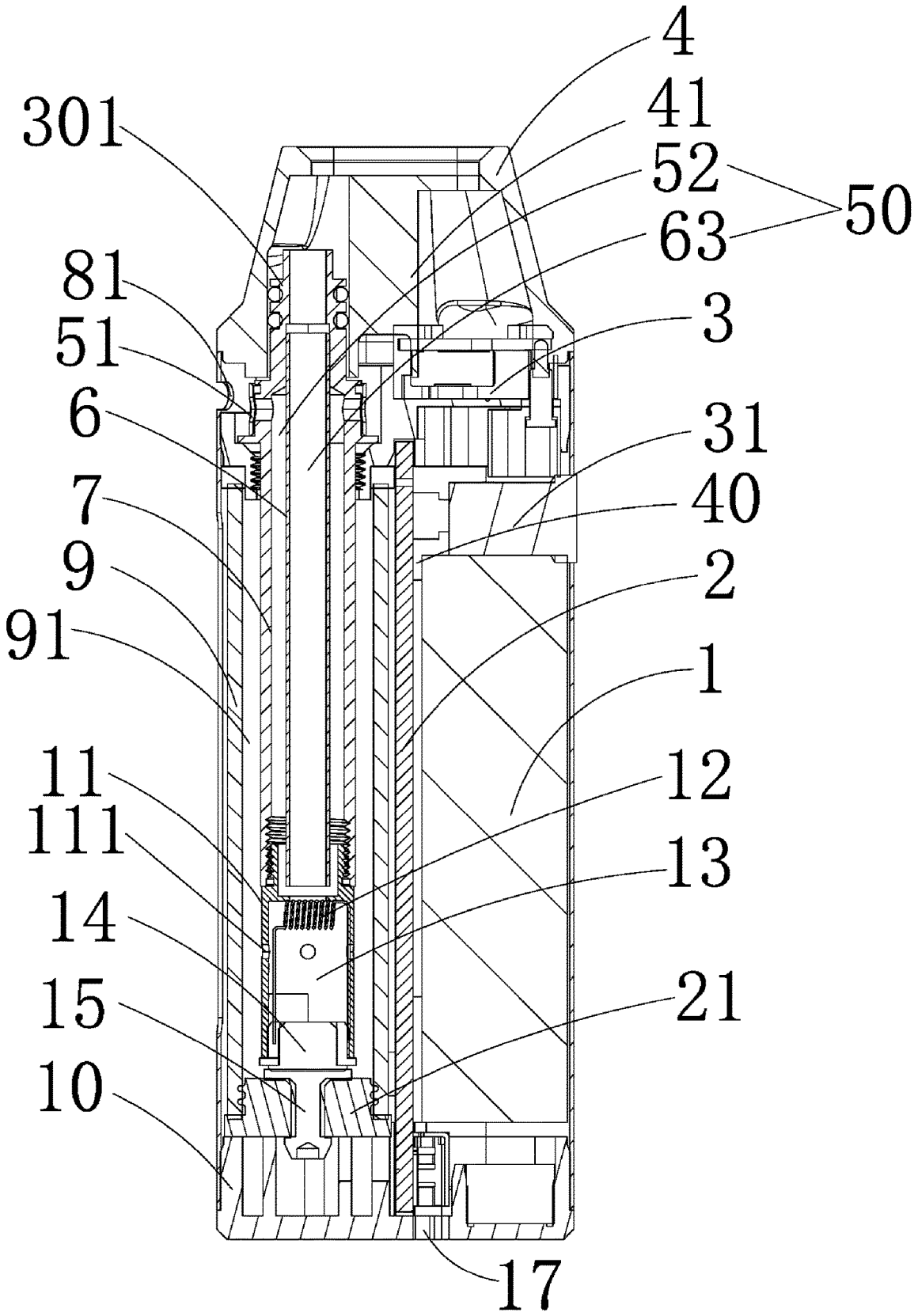
FIG. 19 is a cross sectional view of the electronic cigarette of FIG. 17 along the line of C-C.

According to an example of the embodiment, the suction body 4 may have a plurality of first airflow passage 411 or/and a plurality of second airflow passage 412, and the first airflow passages 411 are isolated from the second airflow passages 412. When the suction body 4 has a plurality of first airflow passages 411, the first airflow passages 411 can disperse the smoke generated by atomizing and has a good cooling effect on the smoke, so that the smoke can have a good taste. When the suction body 4 has a plurality of second airflow passages 412, each second airflow passage 412 can be in fluid communication with a sensor. Only when all the sensors are triggered, the control board will control the battery to energize. So that the safety of the electronic cigarette can be improved, Referring to FIG. 15 and. FIG. 19, an atomizer 30 is provided according to the third embodiment of the present application. The atomizer 30 includes a first airflow passage 50 and a second airflow passage 40. The first airflow passage 50 and the second airflow passage 40 are isolated from each other by a partition member. A sensor 3 is mounted in the second airflow passage 40. The smoke generated by atomizing flows out from the atomizer 30 through the first airflow passage 50.

Figure 15:
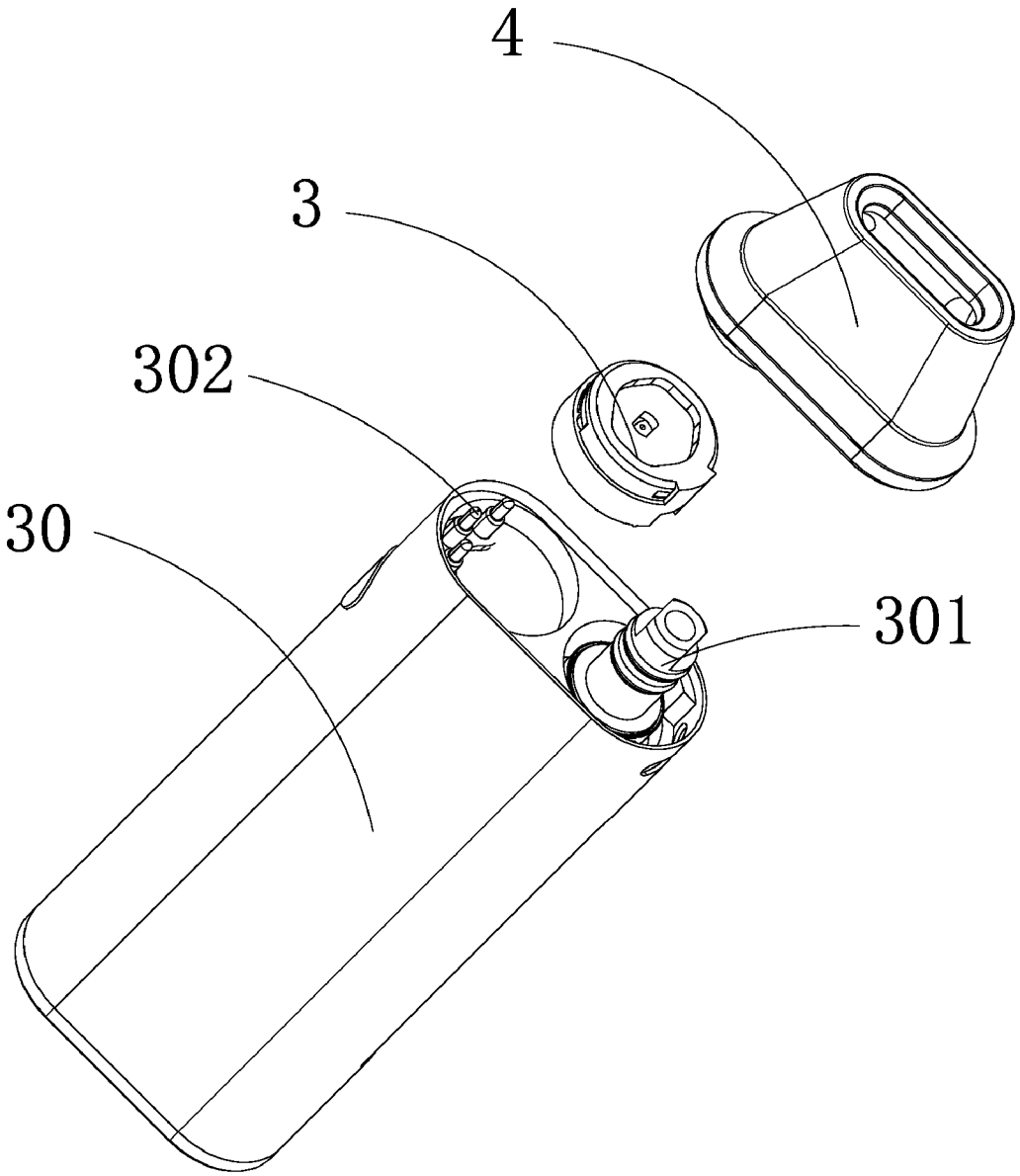
FIG. 15 is an partial exploded view of the electronic cigarette of FIG. 14.
Figure 16:
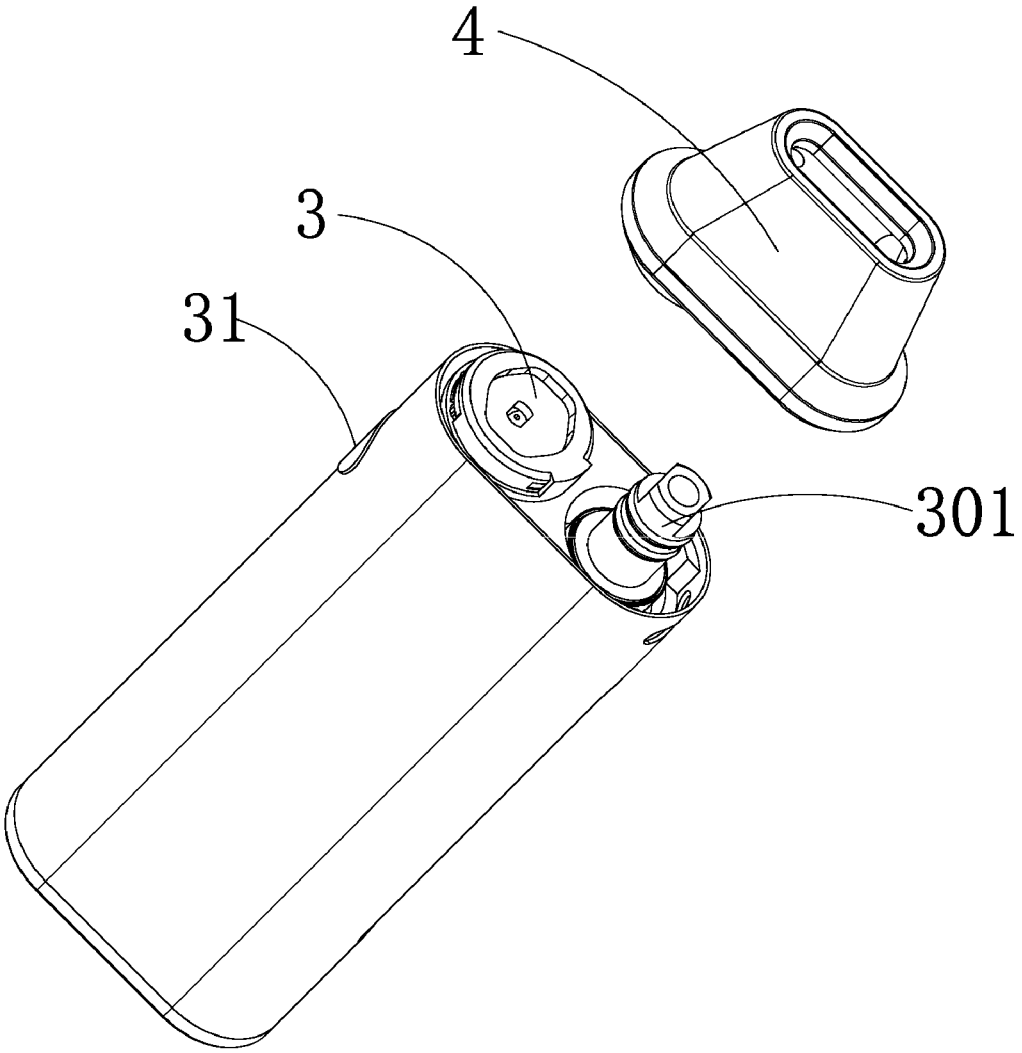
FIG. 16 is another partial exploded view of the electronic cigarette of FIG. 14.

Referring to FIG. 15 and FIG. 16, an electronic cigarette is provided according to the third embodiment of the present application. The electronic cigarette comprises the atomizer 30, the sensor 3 and a suction body 4. According to an example of the embodiment, the suction body 4 and the sensor 3 may be optional spare parts. That is, the electronic cigarette can work properly even though the sensor 3 and the suction body 4 are not mounted to the atomizer 30. The sensor 3 can be fixedly mounted at an end of the atomizer 30 and located in the second airflow passage 40 of the atomizer 30. Alternatively, as shown in FIG. 15 and FIG. 16, the sensor 3 is detachably mounted at an end of the atomizer 30.

Referring to FIG. 15 and. FIG. 19, a sensor probe 302 and an auxiliary suction nozzle 301 are mounted at the upper end of the atomizer 30. The sensor probe 302 is configured to allow a signal connection between the senor 3 and a control board 2, and allow an electrical connection between the sensor 3 and a battery 1, when the sensor 3 is mounted on the upper end of the atomizer 30. The auxiliary suction nozzle 301 is used for the user's suction operation when the suction body 4 is not provided. When the suction body 4 is disposed on the atomizer 30, the auxiliary suction nozzle 301 forms as a part of the first airflow passage 50. Specifically, the auxiliary suction nozzle 301 is received in the suction body 4 and in fluid communication with the suction body 4.

In this embodiment, the electronic cigarette further comprises a main body 8, and the atomizer 30, the sensor 3, the control board 2 and the battery 1 are all received in the main body 8. Alternatively, in other embodiments, the electronic cigarette may comprise two or more than two housings, so that the atomizer 30, the sensor 3, the control board 2 and the battery 1 may be received in different housings. For example, the main body 8 comprises a first housing and a second housing connected with the first housing. The atomizer 30 and the sensor 3 are received in the first housing. The control board 2 and the battery 1 are received in the second housing.

Figure 14:
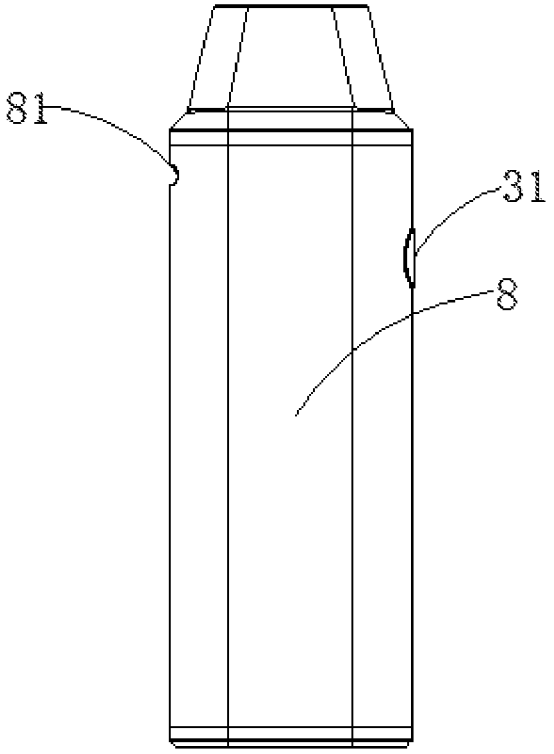
FIG. 14 is a schematic view of an electronic cigarette according to a third embodiment.
Figure 17:
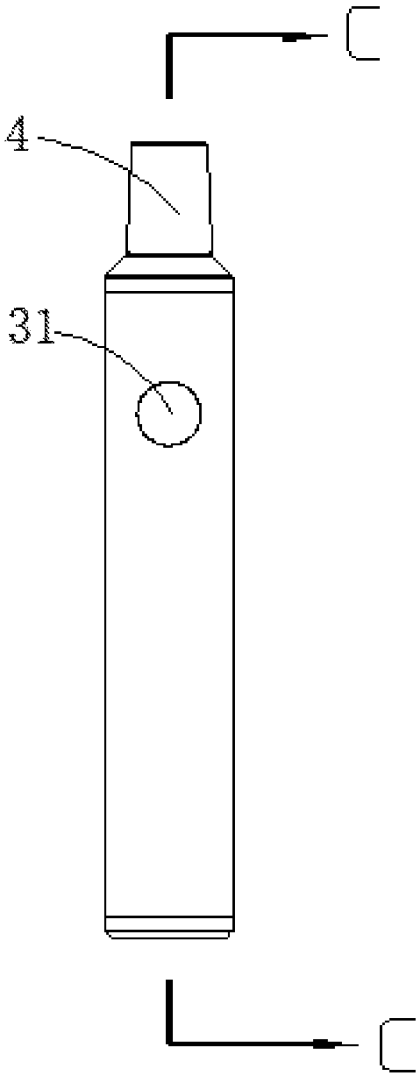
FIG. 17 is a right side view of the electronic cigarette of FIG. 14.
Figure 18:
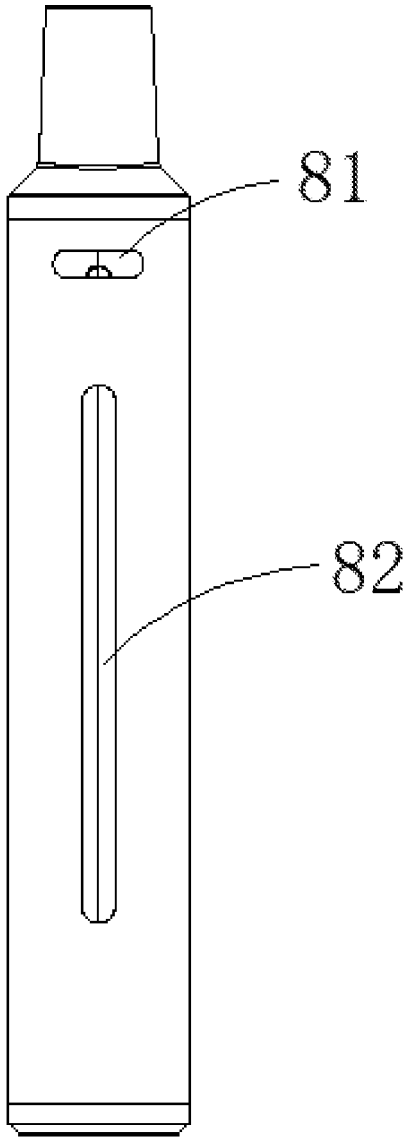
FIG. 18 is a left side view of the electronic cigarette of FIG. 14.

Referring to FIGS. 16-18, the electronic cigarette further comprises a switch 31. The switch 31 can be a mechanical switch as shown in FIG. 14 or a touch pad, as long as the switch 31 can trigger the atomizer 30 to work to generate smoke. In one embodiment, the user can trigger the atomizer 30 through the switch 31 or the sensor 3. In another embodiment, the user can trigger the atomizer 30 through the cooperation of the switch 31 and the sensor 3.

Referring to FIGS. 16-19, the atomizer 30 of this embodiment comprises a first airflow passage 50 and a second airflow passage 40 corresponding to the space of the sensor 3. The main body 8 of the electronic cigarette defines a first air inlet 81 in fluid communication with the first airflow passage 50 and a second air inlet 17 in fluid communication with the second airflow passage 40. In other embodiments, the second air inlet 17 may be a gap between the atomizer 30 and the main body 8. The first airflow passage 50 and the second airflow passage 40 are isolated from each other by the partition member.

Referring to FIG. 4 and FIG. 19, the atomizer 30 of this embodiment further comprises an atomizer head 11 and a venting unit 20. The atomizer head 11 is disposed at one end of the venting unit 20. The venting unit 20 comprises an inner air pipe 6 and an outer air pipe 7. The inner air pipe 6 is disposed inside the outer air pipe 7. The gap between the inner air pipe 6 and the outer air pipe 7 forms as an air inlet passage 52, and the interior passage of the inner air pipe 6 forms as an air outlet passage 63. The lateral wall of the auxiliary suction nozzle 301 defines a venting hole 51 in fluid communication with one end of the air inlet passage 52. At the top end of the atomizer head 11, the other end of the air inlet passage 52 is in fluid communication with the air outlet passage 63. And the end of the air outlet passage 63 opposite to the atomizer head 11 is in fluid communication with the auxiliary suction nozzle 301. The first airflow passage 50 comprises the air inlet passage 52 and the air outlet passage 63. The atomizer 30 further comprises a liquid storage sleeve 9 received in the main body 8. Both the atomizer head 11 and the venting unit 20 are received in the liquid storage sleeve 9. The space between the main body 8 and the liquid storage sleeve 9 forms as the second airflow passage 40. The first airflow passage 50 and the second airflow passage 40 are isolated from each other by the liquid storage sleeve 9. That is, the liquid storage sleeve 9 acts as the partition member of the atomizer 30. When the atomizer 30, the battery 1, the sensor 3 and the suction body 4 are assembled together to form an electronic cigarette, the liquid storage sleeve 9 and the partition member 41 together form as a air flow passage separator for the electronic cigarette.

Referring to FIG. 8, FIG. 9 and FIG. 19, the atomizer head 11 includes an atomizing tube 19, a heating element 12, an atomizing base 13, and a first contact member 14. The heating element 12, the atomizing base 13 and the first contact member 14 are disposed in the atomizing tube 19. The heating element 12 is located above the atomizing base 13. The atomizing tube 19 is provided with an atomizing outlet 192 at one end thereof. The atomizing base 13 is disposed at the other end of the atomizing tube 19 opposite to the atomizing outlet 192. The first contact member 14 is disposed at a bottom end of the atomizing base 13.

It can be seen from the above, in the atomizer 30 provided in this disclosure, the first airflow passage 50 and the second airflow passage 40 are isolated from each other by the partition member. Such that the smoke generated by the atomizer 20 flows in the first airflow passage 50. However, the second airflow passage 40, in which the sensor 3 is disposed, is isolated from the first airflow passage 50 by the partition member, such that the airflows in the two airflow passages are not mixed before being inhaled by the user. That is, the smoke will not flow through the second airflow passage 40. Therefore, even if the smoke cools down, its influence to the sensitivity of the sensor 3 is greatly reduced. Accordingly, the sensor 3 can sensitively control the battery 1 to energize or not. As a result, the smoking experience for the user is improved.

The above embodiments described in detail are several embodiments of the present application only, and should not be deemed as limitations to the scope of the present application. It should be noted that similar variations will become apparent to those skilled in the art to which the present application pertains without departing from its spirit. Therefore, the scope of the present application is defined by the appended claims.

What is claimed is:

1. An electronic cigarette, the electronic cigarette comprising a sensor and an atomizing assembly both of which are disposed in a housing, wherein the atomizing assembly is provided with a first airflow passage, a second airflow passage is provided in the housing, and the sensor is disposed in the second airflow passage, the housing is defined with a first air inlet and a second air inlet, the first air inlet is in fluid communication with the first airflow passage, the second air inlet is in fluid communication with the second airflow passage, the first airflow passage and the second airflow passage are isolated from each other by a partition member;

wherein the atomizing assembly comprises an atomizer head and a venting unit, the atomizer head is disposed at a bottom end of the venting unit, the venting unit comprises an inner air pipe and an outer air pipe, the inner air pipe is coaxial with and disposed inside the outer air pipe, a gap between the inner air pipe and the outer air pipe forms an air inlet passage, two ends of the air inlet passage are respectively in fluid communication with the first air inlet and the atomizer head, an air outlet passage is defined inside the inner air pipe, two ends of the air outlet passage are respectively in fluid communication with the first airflow passage and the atomizer head, whereby the external air enters from the first air inlet, flows downward along the air inlet passage toward the atomizer head, mixes with the smoke generated at the atomizer head, then flows upward along the air outlet passage toward the first airflow passage, and finally exits from the first airflow passage for being inhaled;

wherein the electronic cigarette further comprises a liquid storage unit, the liquid storage unit comprises a liquid storage sleeve, the liquid storage sleeve is coaxial with and disposed outside the outer air pipe, a gap between the liquid storage sleeve and the outer air pipe forms a liquid storage chamber for storing cigarette liquid, the liquid storage chamber is in fluid communication with the atomizer head.

2. The electronic cigarette of claim 1, wherein the housing comprises a main body and a suction body connected at one end of the main body, the partition member is formed in the suction body.

3. The electronic cigarette of claim 2, wherein the main body comprises a connection part provided at the end of the main body to which the suction body is connected, the connection part is provided with two mounting holes which are separately formed, wherein the two mounting holes comprises a first mounting hole and a second mounting hole, the atomizing assembly is mounted in the main body through the first mounting hole, and the sensor is mounted in the second mounting hole.

4. The electronic cigarette of claim 3, wherein the venting unit is provided with a venting hole corresponding to the first air inlet, the venting hole is in fluid communication with the first air inlet and the air inlet passage.

5. The electronic cigarette of claim 4, wherein the venting unit further comprises a venting connection piece, the venting connection piece is mounted in the first mounting hole, the venting hole is defined in a sidewall of the venting connection piece, a top end of the inner air pipe and a top end of the outer air pipe are connected with the venting connection piece.

6. The electronic cigarette of claim 1, wherein the atomizer head comprises an atomizing tube and a heating element, the heating element is disposed in the atomizing tube, a sidewall of the atomizer tube is defined with a liquid inlet hole for the cigarette liquid in the liquid storage chamber to enter into the atomizer tube to be heated and atomized by the heating element, the atomizing tube is provided with an atomizing outlet at one end thereof, the atomizing outlet is in fluid communication with the air inlet passage and the air outlet passage.

7. The electronic cigarette of claim 6, wherein a top end of the atomizing tube is threadedly connected with a bottom end of the outer air pipe.

8. The electronic cigarette of claim 3, wherein the liquid storage unit is disposed in the main body, the liquid storage unit further comprises an end sealing element, the end sealing element is mounted at one end of the liquid storage sleeve, and the other end of the liquid storage sleeve is mounted around a bottom side of the first mounting hole.

9. The electronic cigarette of claim 2, wherein the partition member is integrally formed with the suction body.

10. The electronic cigarette of claim 1, wherein the second air inlet is defined in a sidewall and/or a bottom wall of the housing.

* * * * *